US008631545B2

(12) United States Patent
Ford et al.

(10) Patent No.: US 8,631,545 B2
(45) Date of Patent: Jan. 21, 2014

(54) WATER ACTIVATED EJECTOR MECHANISM FOR ROTARY BUCKLE ASSEMBLY

(71) Applicant: Carleton Life Support Systems, Inc., Davenport, IA (US)

(72) Inventors: Brian Ford, Seminole, FL (US); Kevin Holler, Belleair, FL (US)

(73) Assignee: Carleton Life Support Systems, Inc., Davenport, IA (US)

( * ) Notice: Subject to any disclaimer, the term of this patent is extended or adjusted under 35 U.S.C. 154(b) by 0 days.

(21) Appl. No.: 13/774,073

(22) Filed: Feb. 22, 2013

(65) Prior Publication Data

US 2013/0212845 A1 Aug. 22, 2013

Related U.S. Application Data

(63) Continuation-in-part of application No. 12/837,088, filed on Jul. 15, 2010, now Pat. No. 8,468,660.

(60) Provisional application No. 61/621,267, filed on Apr. 6, 2012, provisional application No. 61/679,929, filed on Aug. 6, 2012.

(51) Int. Cl.
*A44B 11/25* (2006.01)

(52) U.S. Cl.
USPC ..... 24/602; 24/603; 24/632; 24/573.11

(58) Field of Classification Search
USPC ..... 24/602, 603, 573.11, 629, 630, 631, 24/632, 642, 634, 593.1, 579.11, 579.09, 24/643, DIG. 52, DIG. 35, DIG. 47; 297/468, 467, 484
See application file for complete search history.

(56) References Cited

U.S. PATENT DOCUMENTS

| | | | | |
|---|---|---|---|---|
| 2,892,232 | A | 8/1959 | Miller et al. | |
| 2,899,732 | A | 8/1959 | Cushman | |
| 3,228,080 | A * | 1/1966 | Trauger | 24/573.11 |
| 3,564,672 | A | 2/1971 | McIntyre | |
| 3,639,948 | A | 2/1972 | Sherman | |
| 3,747,167 | A | 7/1973 | Pravaz | |
| 4,014,080 | A * | 3/1977 | Caradec | 24/602 |
| 4,441,236 | A * | 4/1984 | Bron | 292/336.3 |
| 4,610,058 | A | 9/1986 | Stemmildt et al. | |
| 4,656,700 | A | 4/1987 | Tanaka et al. | |
| 4,742,604 | A | 5/1988 | Mazelsky | |
| 5,857,246 | A * | 1/1999 | Becnel | 24/602 |
| 7,065,843 | B1 | 6/2006 | Wu | |
| 7,716,794 | B2 | 5/2010 | Wu | |

FOREIGN PATENT DOCUMENTS

| | | |
|---|---|---|
| FR | 1298012 A | 7/1962 |
| GB | 1582973 A | 1/1981 |

* cited by examiner

*Primary Examiner* — Robert J Sandy
*Assistant Examiner* — Abigail E Morrell
(74) *Attorney, Agent, or Firm* — Katherine H. McGuire, Esq.; Woods Oviatt Gilman LLP

(57) ABSTRACT

Disclosed is a rotary buckle assembly for harness. The assembly is adapted to selectively secure or eject the tongue plates for the straps of the harness. The buckle assembly includes a mechanism for automatically releasing the harness in the presence of water.

9 Claims, 10 Drawing Sheets

FIG. 1
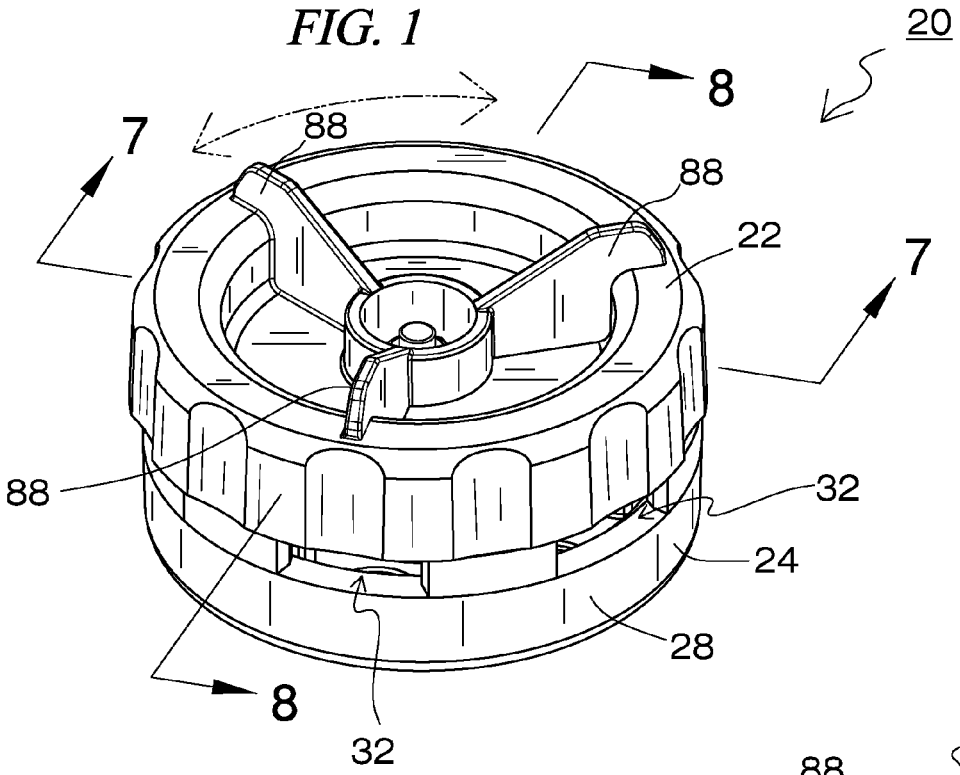
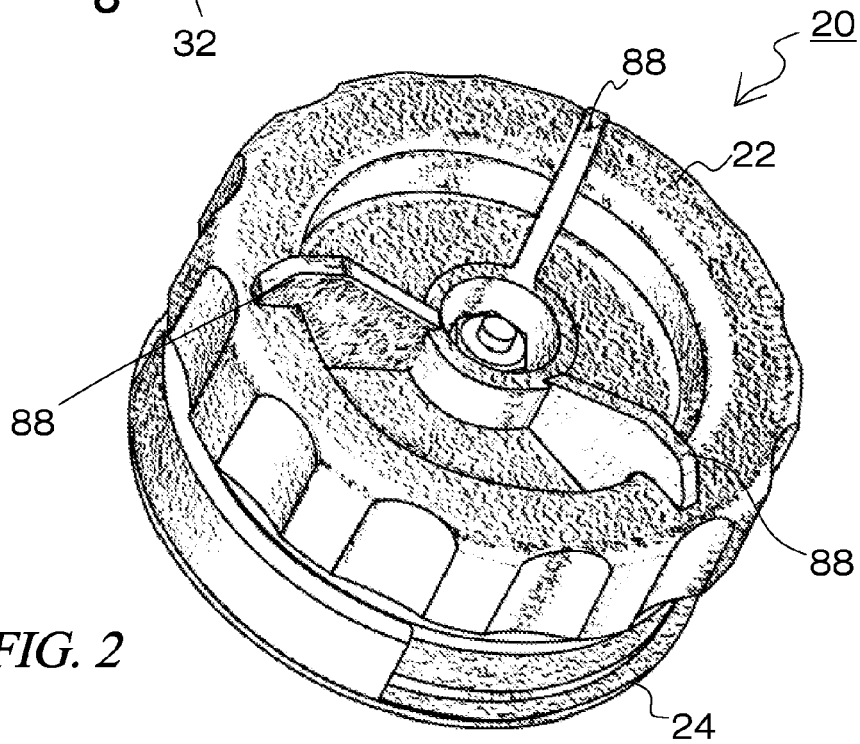
FIG. 2

FIG. 3
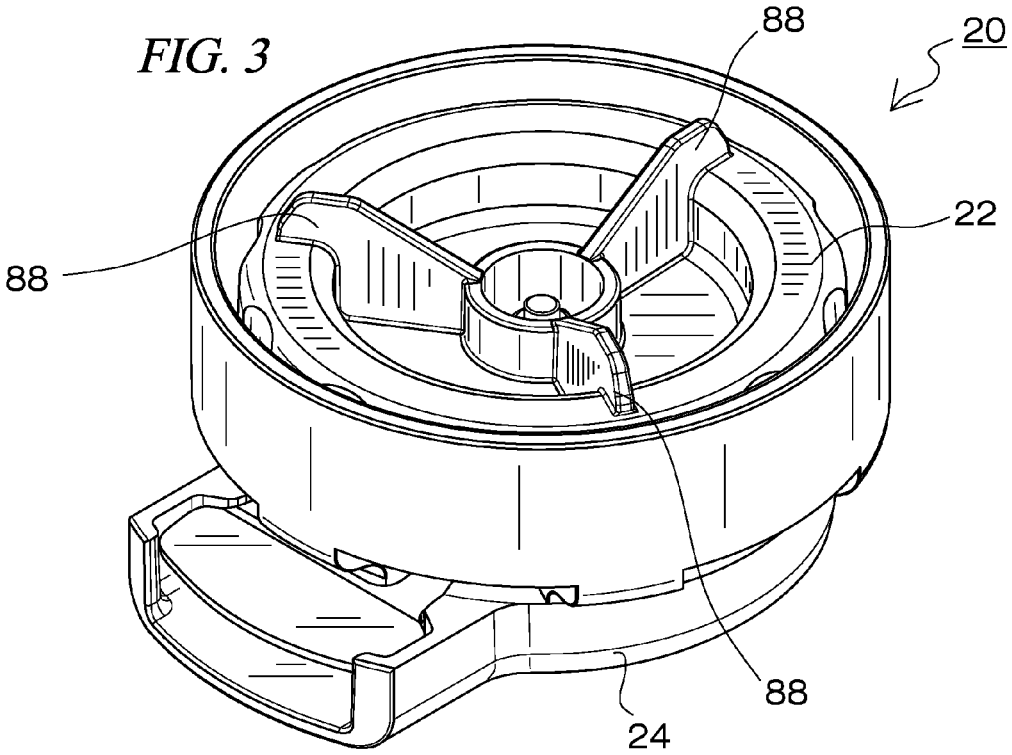
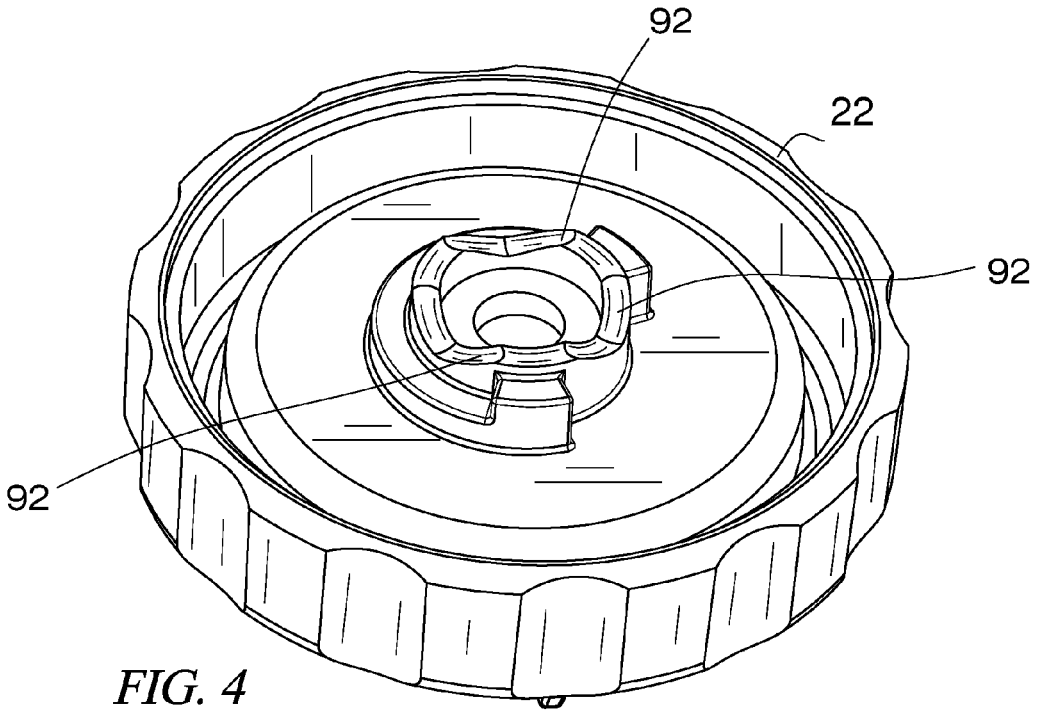
FIG. 4

WATER ACTIVATED EJECTOR MECHANISM FOR ROTARY BUCKLE ASSEMBLY

RELATED APPLICATION DATA

This application is a continuation-in-part of and claims the benefit of priority to application Ser. No. 12/837,088 filed on Jul. 15, 2010, and entitled "Ejector Mechanism for Rotary Buckle Assembly," which claims priority to Provisional Application Ser. No. 61/225,783 filed on Jul. 15, 2009, and entitled "Ejector Mechanism for Rotary Buckle Assembly." The contents of all the foregoing applications are fully incorporated herein.

BACKGROUND OF THE INVENTION

1. Field of the Invention

This invention relates to a rotary buckle assembly. More specifically, the present invention relates to a buckle assembly with a water activated ejection mechanism.

2. Description of the Background Art

The use of multipoint harnesses is known in the art. These harnesses generally include a series of four or more straps that are secured to a common buckle assembly by way of tongue plates. These harnesses further include a single release mechanism, whereby a user can simultaneously unlock all the tongue plates in a single operation.

An example of one such harness is described in U.S. Pat. No. 2,892,232 to Quilter. Quilter discloses a quick release device that employs a series of loading springs. The loading springs include forked leaves that engage rockers. The rockers, in turn, selectively engage strap lugs. The strap lugs can be disengaged by rotating a central knob.

Another example of a multipoint harness is disclosed in U.S. Pat. No. 2,899,732 to Cushman. Cushman discloses a quick release buckle that includes a tripping disc. Tripping disc engages a detent lug over the bias of a compression spring. The detent lugs include beveled surfaces for engaging an opening within the tongue strap.

The above referenced buckles all suffer from the fact that they do not automatically release in the presence of water. Studies have shown that drownings often occur in otherwise survivable crash, and that many times the victims are found still buckled into their seats. Having a buckle that automatically releases upon submersion into water would save precious time in allowing the occupant to egress from the vehicle. It would also eliminate the potential for panic situations where occupants forget or cannot remember how to release their buckles. Panic happens quite often even after training to reduce its likelihood.

What is needed, therefore, is a buckle assembly for a multipoint harness that automatically releases in the presence of water. The present disclosure is aimed at fulfilling these and other needs present in the art.

SUMMARY OF THE INVENTION

It is therefore one of the objectives of this invention to provide an ejection mechanism for a multipoint harness wherein the mechanism forcibly ejects a series of tongue plates when unlocked.

It is also an object of the present invention to provide a buckle mechanism that automatically releases in the presence of water.

It is a further object of the present invention to provide an automatic release mechanism that releases when immersed in water but that provides a slight delay prior to release.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which:

FIG. 1 is a perspective view of the rotary buckle of the present invention.

FIG. 2 is a perspective view of the textured surface of the rotary buckle.

FIG. 3 is a perspective view of the rotary buckle of the present invention.

FIG. 4 is a perspective view of the underside of the upper cover.

Similar reference characters refer to similar parts throughout the several views of the drawings.

DETAILED DESCRIPTION OF THE PREFERRED EMBODIMENT

Figure 5:
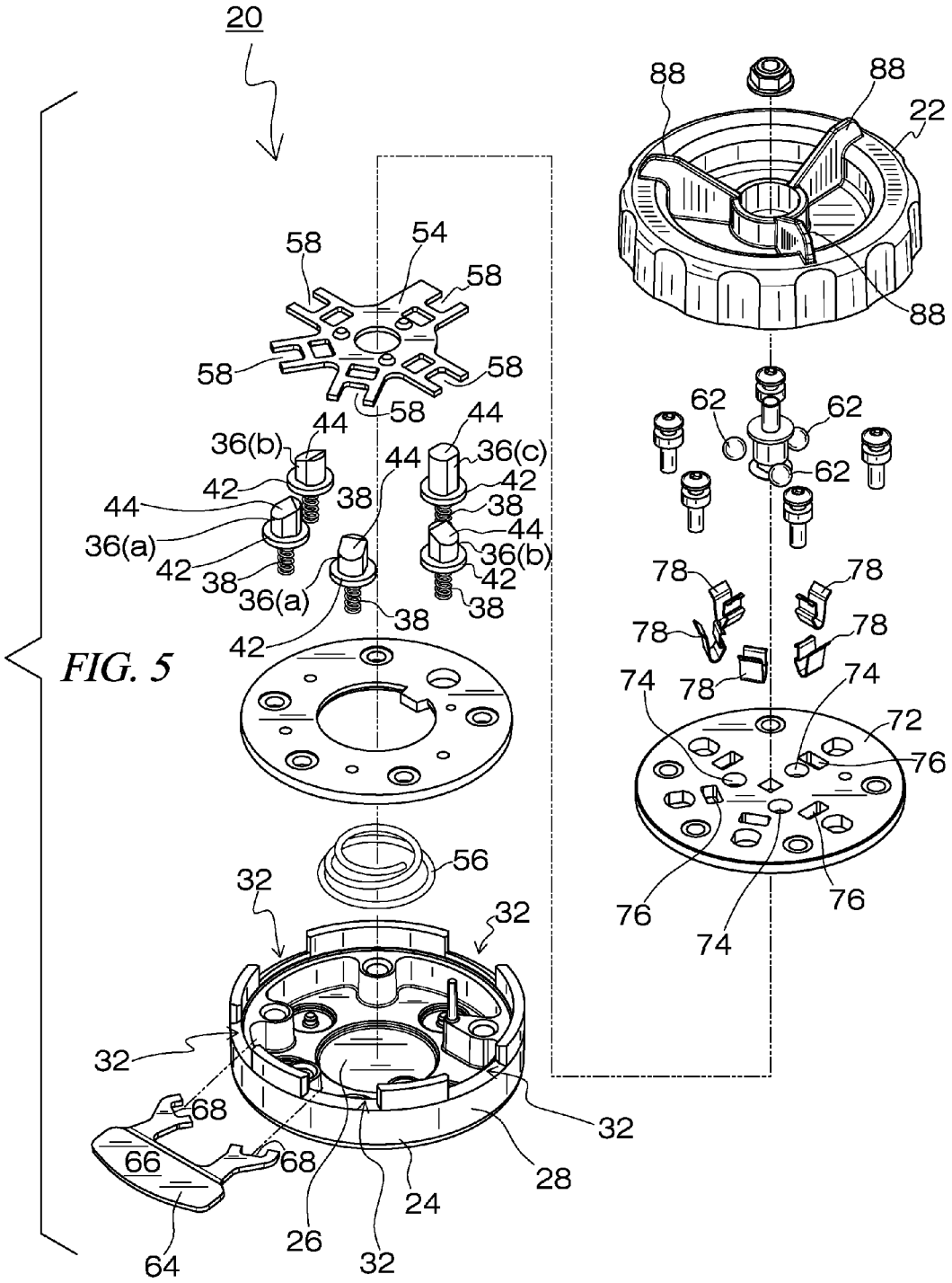
FIG. 5 is an exploded view of the rotary buckle of the present invention.

The present invention relates to a rotary buckle assembly for harness. The assembly is adapted to selectively secure or eject the tongue plates for the straps of the harness. Although the invention finds particular application for use with a five point harness, it can be adapted for use with other harness arrangements. The various features of the present invention, and the manner in which they interrelate, will be described in greater detail hereinafter.

With reference to FIG. 1, the buckle assembly 20 of the present invention is depicted. In the preferred embodiment, assembly 20 includes first and second cover portions (22 and 24). These covers (22 and 24) are preferably cylindrically shaped. Additionally, as noted in FIG. 5, second cover 24, which is the lowermost cover includes a lower surface 26 and an upstanding peripheral wall 28. In the preferred embodiment, peripheral wall 28 includes a series of five equally spaced tongue openings 32 to accept buckle tongues 94 as described hereinafter.

Figure 6:
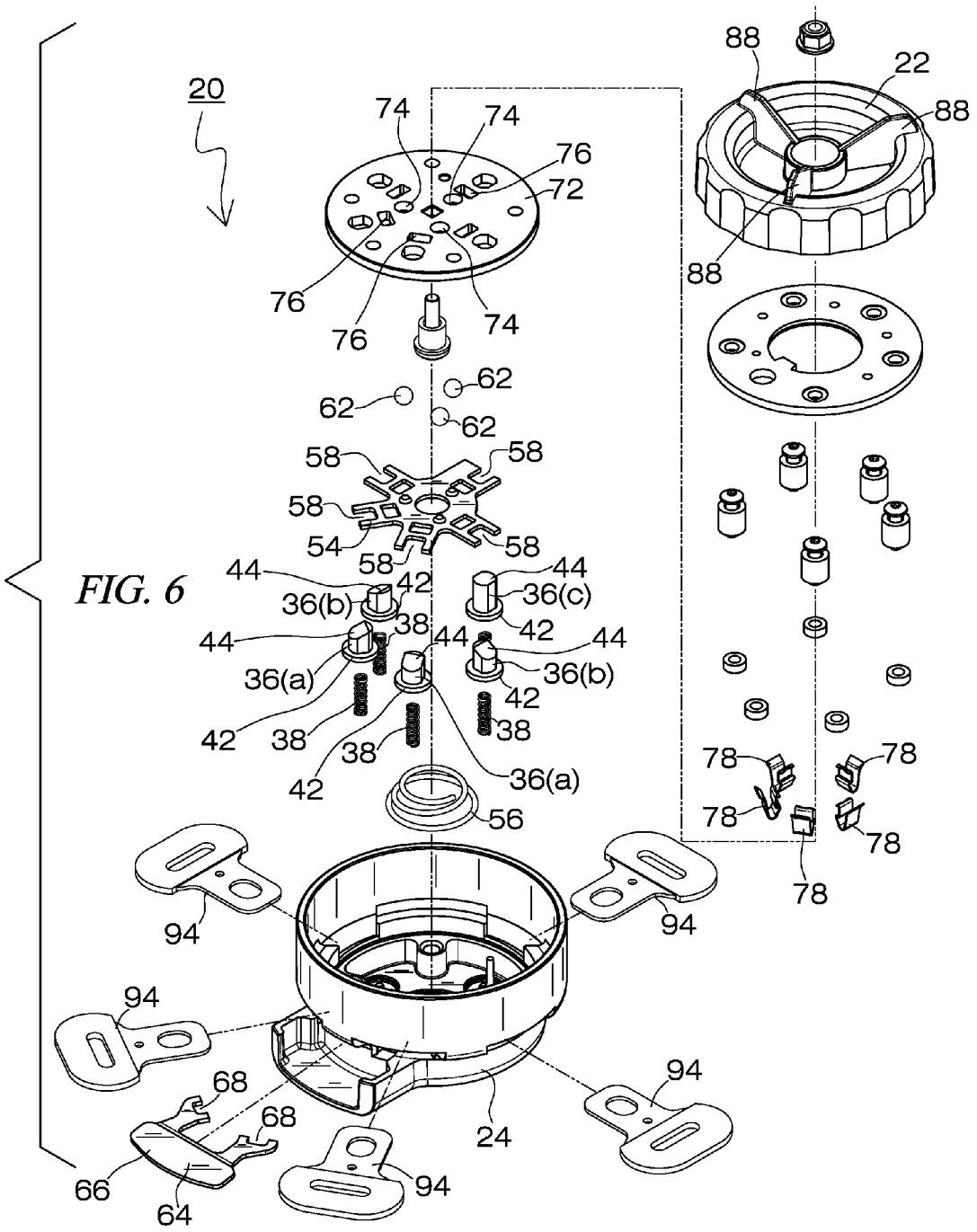
FIG. 6 is an exploded view of the rotary buckle along with the associated belt tongues.
Figure 7:
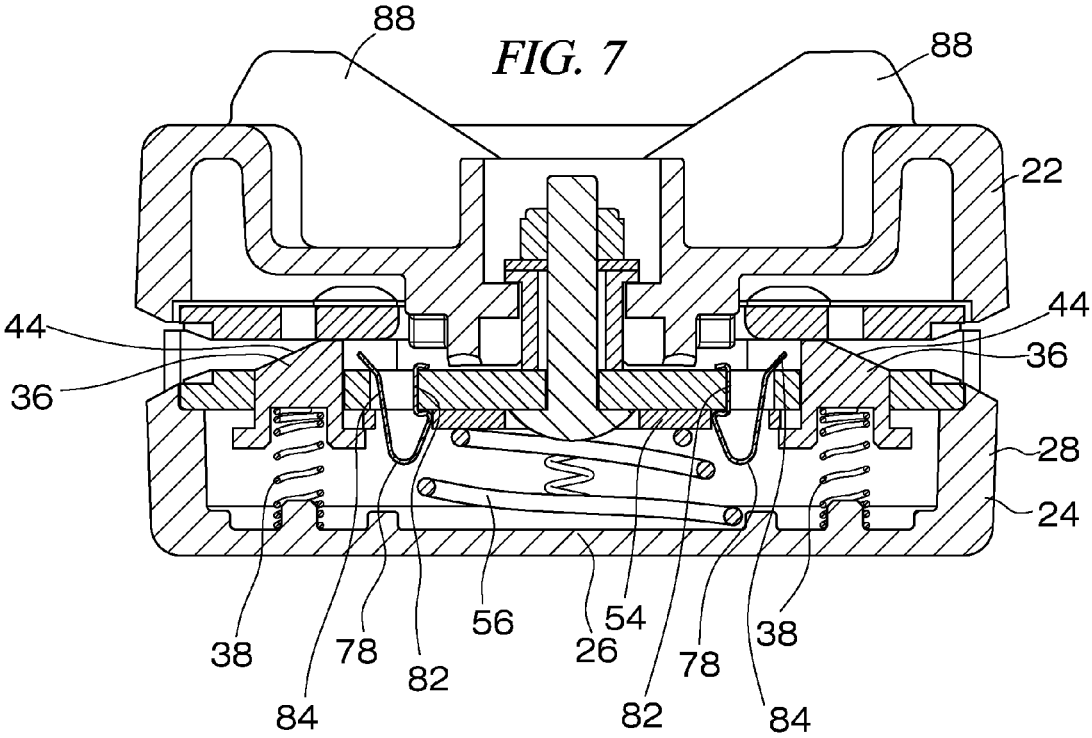
FIG. 7 is a cross sectional view of the rotary buckle taken along line 7-7 of FIG. 1.

With reference to the exploded views of FIGS. 5 and 6, the locking dogs 36 of the present invention are described. As noted more fully hereinafter, dogs 36 serve to lockingly engage a female opening in a corresponding tongue plate 94. As illustrated, locking dogs 36 are each interconnected to the lower surface 26 of second cover 24 via mounting springs 38. Springs 38 permit each dog 36 to be downwardly displaced against the spring force. Each of the locking dogs 36 further includes a lower peripheral flange 42 and an upper surface 44. As noted, each dog selectively secures one of the straps of the harness.

In the case of a five point harness, there are two shoulder dogs 36(*a*) for securing shoulder belts, two lap dogs 36(*b*) for securing lap belts, and one anchor dog 36(*c*) for securing a crotch belt. Shoulder dogs 36(*a*) and lap dogs 36(*b*) preferably include a beveled upper surface 44 to facilitate the insertion and withdraw of a tongue plate 94. However, anchor dog 36(*c*) does not include a beveled top surface 44. Moreover, in the preferred embodiment, anchor dog 36(*c*) is elongated with respect to the other dogs 36(*a*) and 36(*b*) such that it remains secured to tongue plate 94 while the other tongue plates are ejected. This ensures that the assembly 20 remains secured to one of the harness straps at all times.

Dogs 36 are moved into a unlocked orientation by way of a disengagement plate 54. Disengagement plate 54 is interconnected to the lower surface of first cover 22 via a primary spring 56. In the case of the depicted five point harness, disengagement plate 54 includes five peripherally located forks 58, with each fork 54 corresponding to a locking dog 36. Forks 54 are secured over the peripheral flange 42 of the corresponding locking dog 36, whereby the displacement of the disengagement plate 54 against the force of the primary spring 56 results in the displacement of the locking dogs 36 against the force of the mounting springs 38. Thus, the downward displacement of plate 54 displaces the locking dogs 36 to thereby release the tongue plates 94. However, as noted above, locking dog 36(*c*) is elongated and, therefore, remains lockingly engaged with its tongue plate 94 even upon displacement of plate 54.

Figure 8:
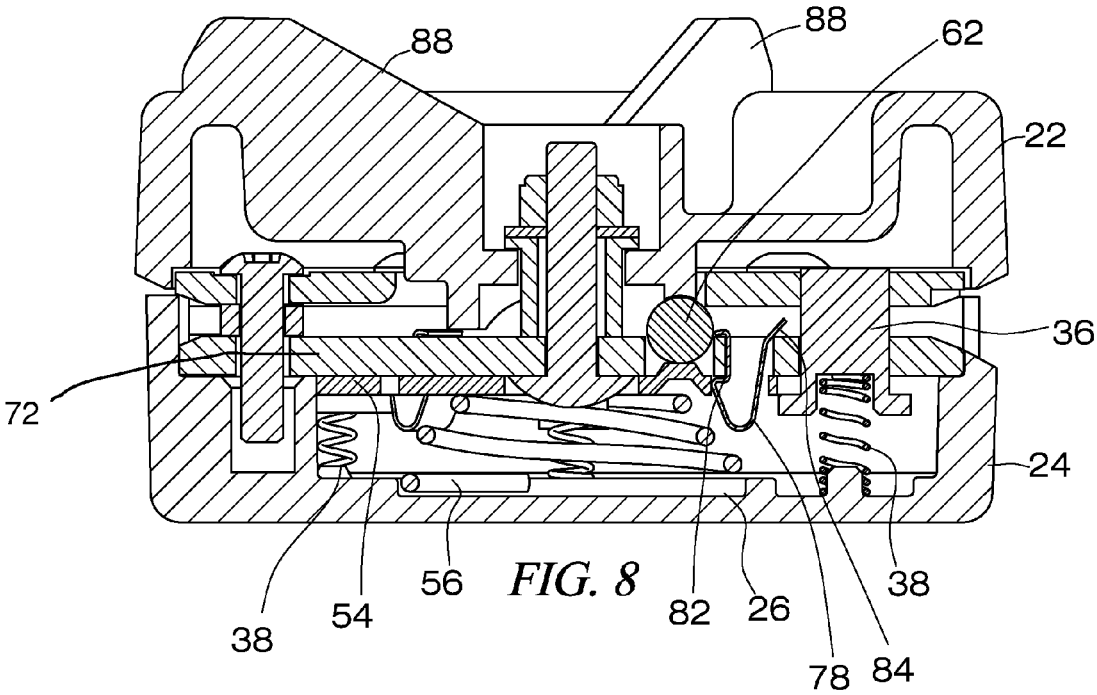
FIG. 8 is a cross sectional view of the rotary buckle taken along line 8-8 of FIG. 1.

As noted in the cross sectional view of FIG. 8, a series of bearings 62 are employed in the downward movement of displacement plate 54. In the preferred embodiment, three ball bearings 62 are utilized. These bearings 62 are supported within recesses in the disengagement plate 54. The exact function of these bearings is described in greater detail hereinafter.

An optional shoulder release plate 64 can also be included within assembly 20. Release plate 64 includes a handle 66 to be grasped by the user and oppositely disposed forks 68. In a fashion similar to the displacement plate 54, forks 68 of release plate 64 engage flanges 42 of the two shoulder dogs 36(*a*). As such, the pivoting and/or downward displacement of handle 64 results in the displacement of the two shoulder dogs 36(*a*) and the selective release of the tongue plates 94 of the shoulder straps. Shoulder plate 64 can be displaced without displacing disengagement plate 54. As a result, the user can selectively remove the shoulder straps without unlocking the remaining straps of the harness.

With continuing reference to FIGS. 5 and 6, a cover plate 72 is positioned over disengagement plate 54. Cover plate 72 includes a series of apertures 74 for receiving bearings 62 of disengagement plate 54. Cover plate 72 further includes a series five slotted openings 76, with the slotted openings 76 corresponding to the position of the five locking dogs 36. Cover plate 72 is secured to the disengagement plate 54 via conventional fasteners such that both plates reciprocate together during the ejection process. An additional upper plate can likewise be included within the housing as noted in the exploded views.

Figure 9:
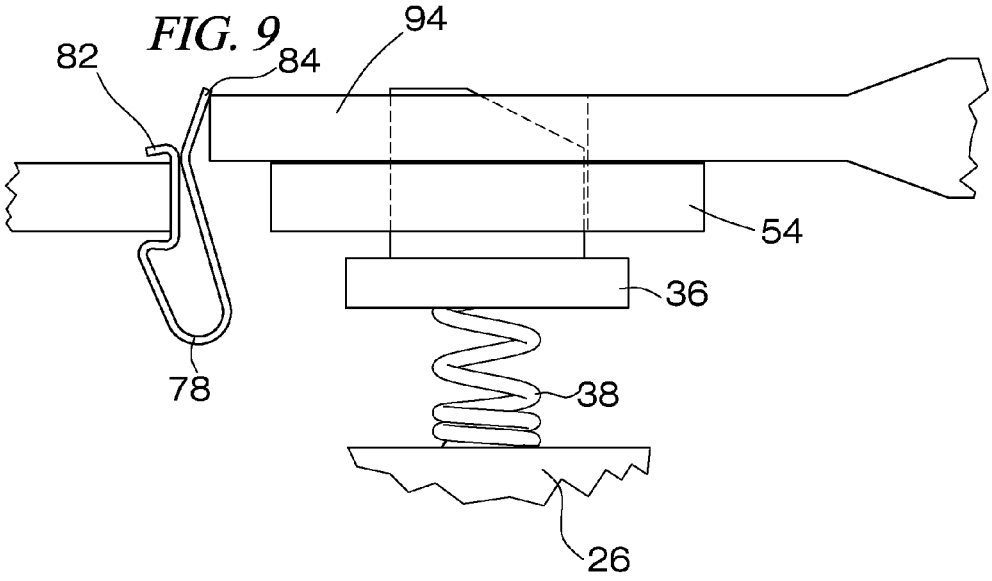
FIG. 9 is a detailed view of one of the ejector springs of the present invention with the belt tongue in the locked position.
Figure 10:
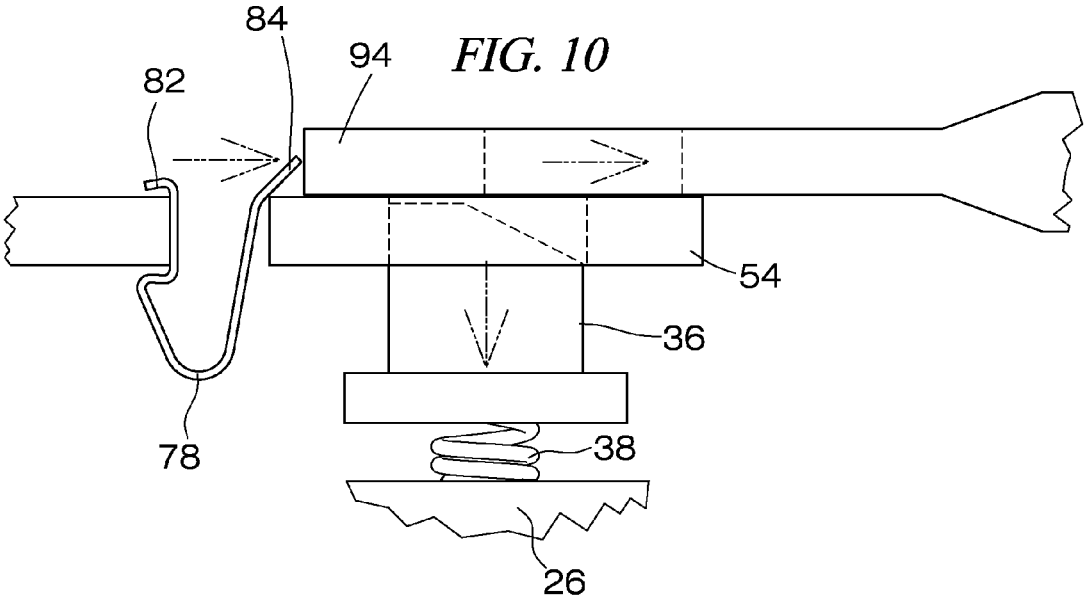
FIG. 10 is a detailed view of one of the ejector springs of the present invention with the belt tongue being ejected from the housing.

The ejector springs 78 of the present invention are next described in connection with FIGS. 9 and 10. In the preferred embodiment, a series of five ejector 78 springs are utilized, with each of the ejector springs 78 corresponding to an associated tongue plate. Each spring 78 is positioned within one of the slotted openings 76 of the cover plate 72. Each ejector spring 78 is designed to both secure its associated tongue plate 94 when locked and to forceably eject the tongue plate 94 when unlocked. In order to accomplish this, each ejector spring 78 includes a first half in the form of a c-shaped channel 82. This c-shaped channel 82 engages and is locked to the edge of the slotted opening 76 to which the spring is mounted. The other half of the spring is angled 84 and releasably engages the forward end of a corresponding tongue plate 94.

When in the locked orientation, the two halves 82 and 84 are forced together under tension. As such, when the dogs 36 are disengaged from the tongue plates 94 (as described above), the angled halves 84 of the springs 78 serve to forceably eject the tongue plates 94 from the assembly 20. However, when the dogs 36 are engaged, the angled halves 84 of the ejector springs 78 serve to secure and otherwise stabilize the tongue plate 94 within the assembly 20.

The assembly 20 is closed by way of the first cover 22. As illustrated, the first cover 22 is cylindrically shaped. First cover 22 is rotatably secured both to the second cover 24 and to the disengagement plate 54. In the preferred embodiment, first cover 22 includes a textured outer surface and three upstanding fins 88 to permit easy manipulation by the user. As illustrated in FIG. 4, first cover 22 includes an inner surface with a series of ramps 92. The number of ramps 92 corresponds to the number of bearings 62 included on the disengagement plate 54. In the depicted embodiment, three bearings 62 and three ramps 92 are utilized. The ramps 92 engage the bearings 62 of disengagement plate 54. Rotation of the first cover 22 results in inclined ramps 92 sliding over bearings 62. This, in turn, results in the downward displacement of disengagement plate 54. This can be achieved by orienting bearings 62 within apertures in cover plate 72. Namely, as inclined ramps 92 incrementally engage bearings 62, bearings 62 contact disengagement plate 54 through the apertures within cover plate 72 (note FIG. 8). This, in turn, results in the downward movement of disengagement plate 54 and the release and ejection of the tongue plates 94.

Water Activated Release Mechanisms

Figure 11:
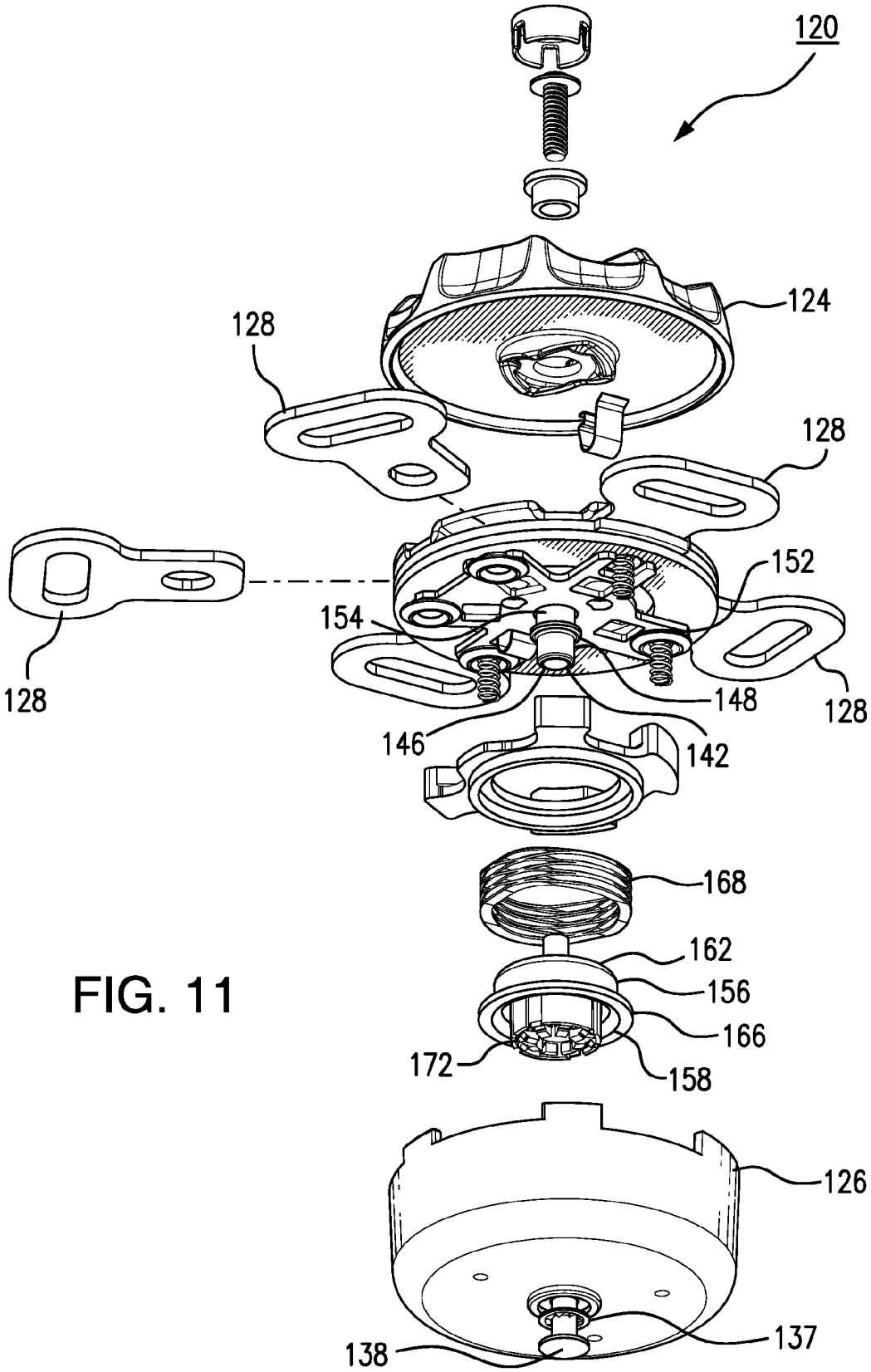
FIG. 11 is an exploded view of a water activated embodiment of the present invention.
Figure 12:
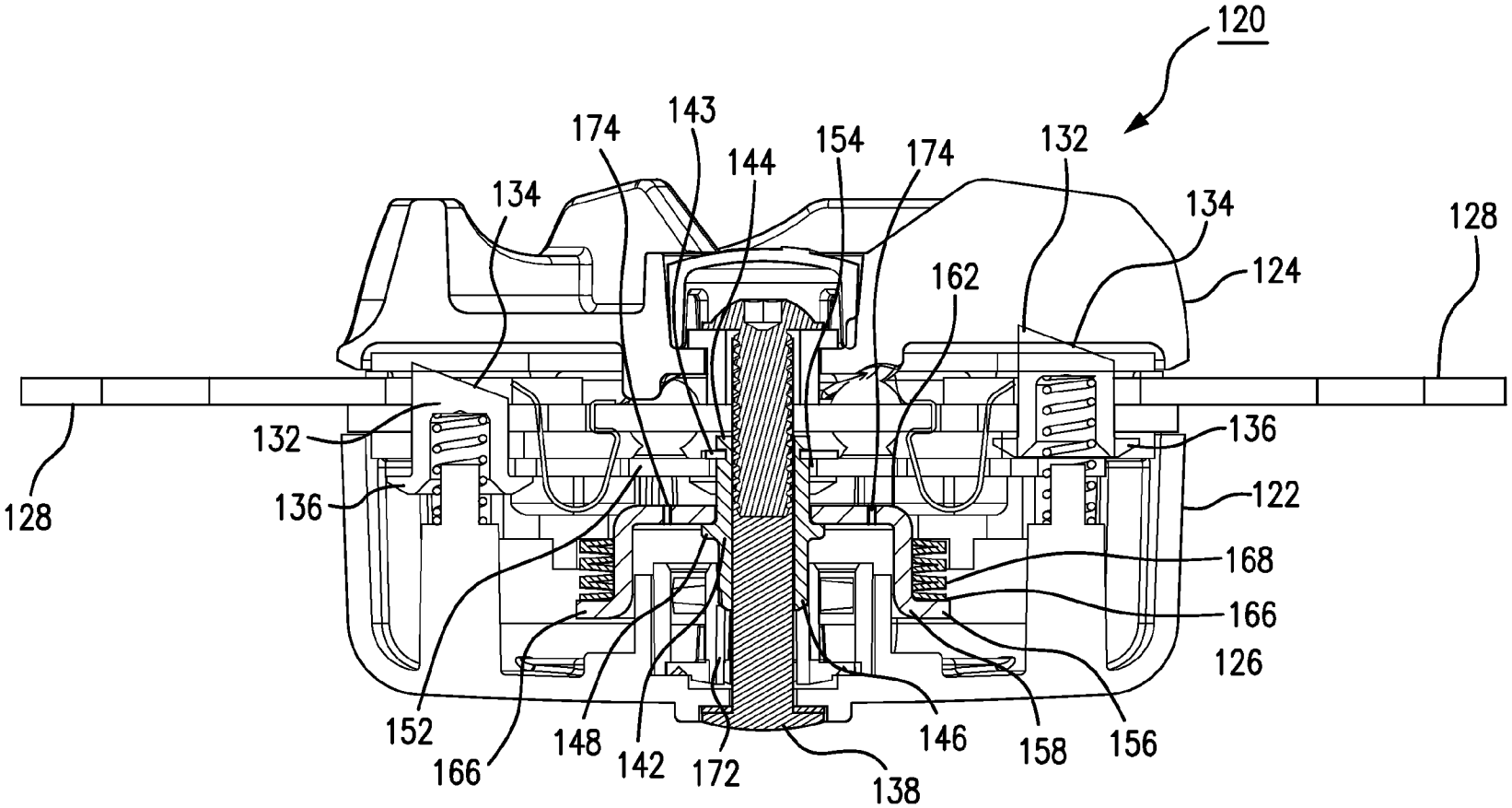
FIG. 12 is a cross sectional view of the rotary buckle of FIG. 11.
Figure 13:
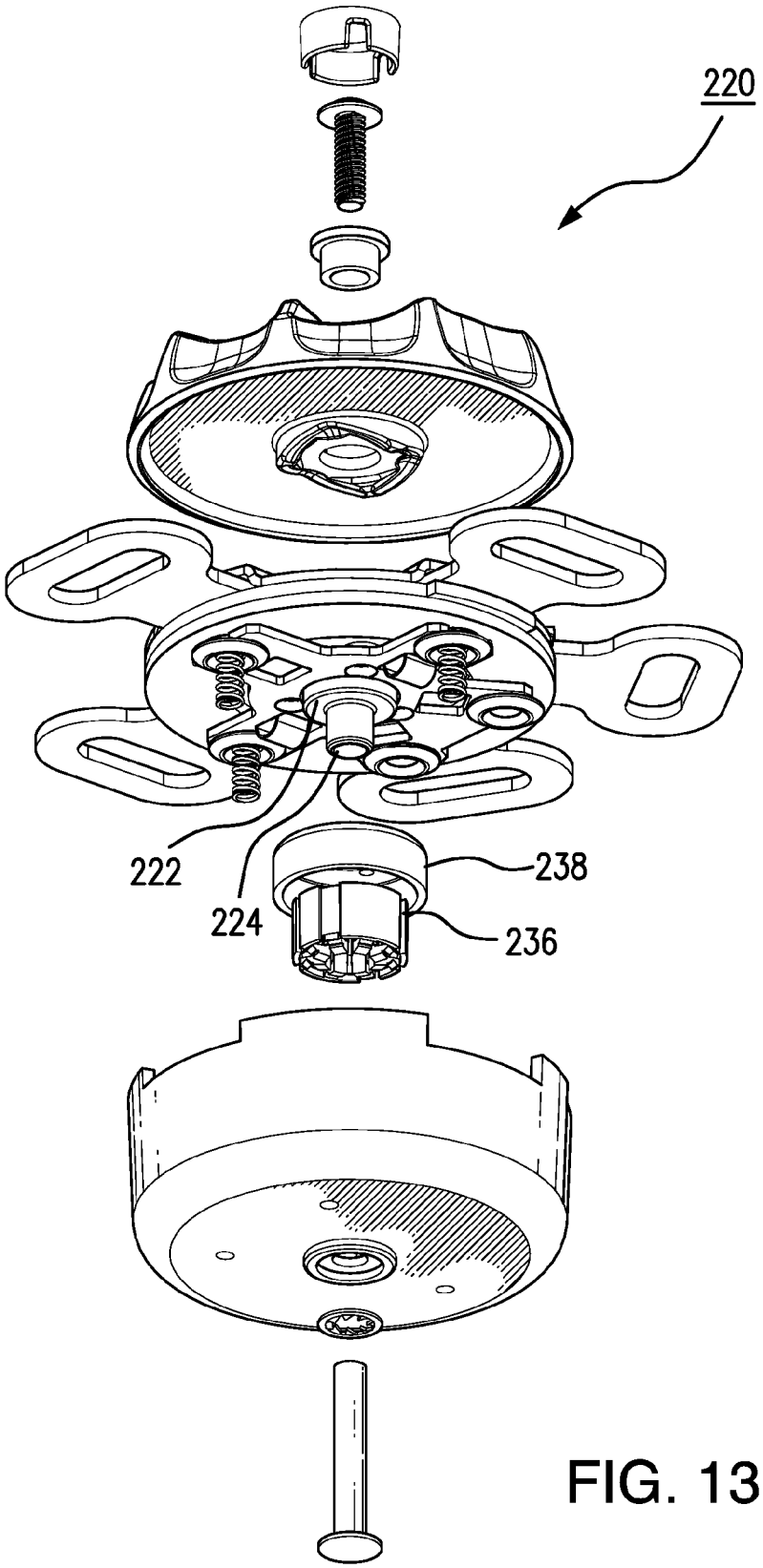
FIG. 13 is an exploded view of an alternative water activated embodiment of the present invention.
Figure 14:
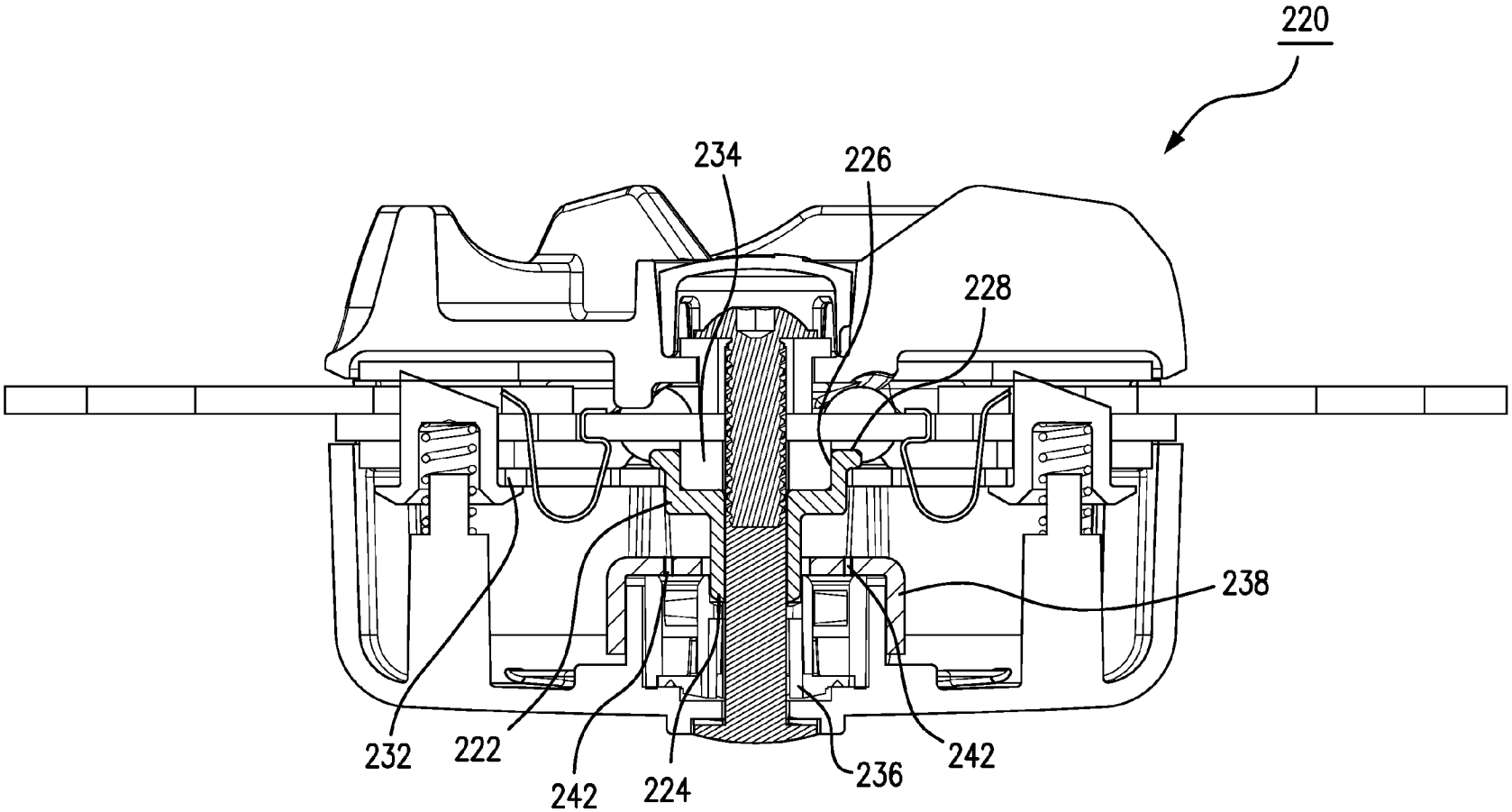
FIG. 14 is a cross sectional view of the rotary buckle of FIG. 12.

Two different water activated embodiments are shown in FIGS. 11-14. Specifically, a first water activated embodiment is depicted in FIGS. 11-12, and a secondary water activated embodiment is depicted in FIGS. 13-14. Both embodiments includes a water dissolvable bobbin and permits the buckle to automatically release in the presence of water. The details of these embodiments are more fully described hereinafter.

As noted in the exploded view of FIG. 11 and the cross-sectional view of FIG. 12, this embodiment 120 shares many of the same features as the above described embodiment. Namely, the embodiment includes a housing 122 with an upper rotary handle 124 and a lower base 126. Housing 122 lockingly receives a plurality of tangs 128 about a peripheral extent. Likewise, a plurality of pawls 132 are positioned within housing 122. Each of pawl 132 has an upper beveled surface 134 and a lower foot 136. The number of pawls 132 corresponds to the number of tangs 128. In the depicted embodiment, five tangs 128 and pawls 132 are included. Each pawl 132 has a raised position wherein it locks the corresponding tang 128 within housing 122 and a lowered position wherein the corresponding tang 128 can be ejected.

A binding post 138 is centrally positioned within housing 122 and interconnects rotary handle 124 to base 126. Binding post 138 can be formed from two or more threadably interconnected elements. An actuator 142 is slidably positioned over binding post 138. A lock ring 137 may be included at one or both ends of post 138. The exact function of actuator 142 is described in more detail hereinafter. Actuator 142 has an upper end 144, a lower end 146, and a step 148 located therebetween. Actuator 142 has raised position corresponding to the locked configuration of buckle mechanism 120 and a lowered position corresponding to the unlocked configuration of buckle mechanism 120.

The water activated embodiment similarly uses a disengagement plate 152 positioned within housing 122. As illustrated, disengagement plate 152 has a central aperture 154 that is connected to actuator 142. More specifically, actuator 142 is positioned within aperture 154. Actuator 142 is then interconnected to plate 152 via a retaining ring 143. Other means of connection are also within the scope of the invention. This permits actuator 142 and disengagement plate 152 to travel together between raised and lowered positions. Disengagement plate 152 contacts the lower feet 136 of pawls 132. This contact permits actuator 142 to lower disengagement plate 152 and the interconnected the pawls 132.

Movement of disengagement plate 152 and actuator 142 is controlled by a spring biased cup 156. Spring cup 156 is most clearly depicted in FIG. 12. Spring cup 156 is defined by an opened lower end 158 and an upper end 162 with a central aperture 164. A peripheral edge 166 is located about the lower opened end 158 of spring cup 156. Actuator 142 is positioned within the central aperture 164 of spring cup 156. Step 148 contacts spring cup 156 such that downward movement of spring cup 156 effects a similar downward movement of actuator 142. A wave spring 168 is positioned about spring cup 156 and contacts lower peripheral edge 166. As described in more detail below, when water is detected, spring 168 is permitted to expand and force spring cup 156, actuator 142, and disengagement plate 152 into lowered positions. In the absence of water, however, spring 168 is stored in a compressed configuration.

The water activation is achieved via a water dissolvable bobbin 172. One suitable bobbin is the water-activated bobbin sold by Halkey-Roberts Corporation of St. Petersburg, Fla. Bobbin 172 is the positioned within the opened lower end 158 of spring cup 156. The internal portion of bobbin 172 supports the lower end 146 of actuator 142 and, thereby, keeps actuator 142 in the raised position. Bobbin 172, however, dissolves in the presence of water. Thus, when bobbin 172 dissolves, the lower end 146 of actuator 142 is no longer supported by bobbin 172. This allows wave spring 168 to expand and force spring cup 156, actuator 142, and disengagement plate 152 to the lowered position. As disengagement plate 152 moves to the lowered position, it engages feet 136 of pawls 132 to likewise move pawls 132 to the lowered position. This, in turn, allows tangs 128 to be released from housing 122. As in the primary embodiment, ejector springs forcibly eject tangs 128 once released.

Spring cup 156 can optionally include a timing diffuser option to regulate the time between housing 122 being submerged in water and the automatic ejector being triggered. In some situations, it is preferable to give the occupant a small amount of time before releasing the occupant from the restraint. This time allows the vehicle to cease movement and may allow the occupant to become orientated following a crash. A timing diffuser is created by positioning drainage holes 174 in upper end 162 of the spring cup 156. Bobbin 174 may include an internal bobbin component and an external bobbin holder. There are preferably slits around the periphery of the bobbin holder to allow for the entry of water. Without slits, air pockets may form that prohibit water from contacting the internal bobbin. The bobbin is otherwise positioned within a water tight closure within the housing. Drainage apertures 174 regulate the amount of water flowing into the area around bobbin 172. Depending upon the size and number of the apertures provided, this arrangement creates a time delay before bobbin 172 is immersed and dissolved.

An additional water activated embodiment 220 is illustrated in the exploded view of FIG. 13 and the cross sectional view of FIG. 14. This embodiment 220 shares all of the same features described above in connection with FIGS. 11 and 12. However, in this embodiment, spring cup 222 opens upwardly. More specifically, spring cup 222 positioned about the binding post and includes a lower end 224, an internal peripheral area 226, and an upper peripheral lip 228. Lip 228 contacts the central aperture of disengagement plate 232. An elastomeric compression spring 234 is positioned within inner peripheral area 226.

A water dissolvable bobbin 236 is positioned about the binding post. Bobbin 236 supports the lower end 224 of spring cup 222. Bobbin 236 may be of the same construction as the bobbin depicted in FIGS. 11 and 12. As such, bobbin 236 is designed to dissolve in the presence of water. When dissolved, lower end 224 of spring cup 222 is released and the compression spring 234 forces spring cup 222 and disengagement plate 232 downward to thereby release the tangs.

A separate timing diffuser 238 can be positioned over bobbin 236. The timing diffuser 238 is formed from a cylindrical cap with a series of drainage apertures 242. The drainage apertures 242 regulating the volume of water contacting the water dissolvable bobbin 236.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An ejection mechanism for a buckle assembly, the ejection mechanism comprising:

a series of tangs releasably secured within a housing;

a plurality of pawls positioned within the housing, the number of pawls corresponding to the number of tangs, each pawl having a raised position wherein it locks the corresponding tang within the housing and a lowered position wherein the tang can be released from the housing;

a disengagement plate positioned within the housing and contacting the pawls, the disengagement plate having raised and lowered positions, the pawls being brought into the lowered position when the disengagement plate is in the lowered position;

a support positioned within the housing, the support having upper and lower ends, the upper end coupled to the disengagement plate, the support having raised and lowered positions, the disengagement plate being brought into the lowered position with the support in the lowered position;

a resilient member interconnected to the support and urging the support into the lowered position;

a bobbin positioned beneath the support and preventing it from moving into the lowered position, the bobbin releasing the support in the presence of water, whereby the resilient member forces the support and disengagement plate into the lowered position to release the tangs.

2. The ejection mechanism as described in claim 1 wherein the bobbin is water dissolvable.

3. The ejection mechanism as described in claim 2 further comprising a timing diffuser positioned over the bobbin, the timing diffuser formed from a cylindrical cap with a series of drainage apertures, the drainage apertures regulating the volume of water contacting the bobbin.

4. The ejection mechanism as described in claim 1 wherein the housing comprises an upper rotary handle and a lower base that are interconnected via a binding post.

5. The ejection mechanism as described in claim 1 further comprising a centrally positioned post within the housing, wherein the support is a cup shaped member that is slidably positioned over the post.

6. The ejection mechanism as described in claim 4 wherein the cup shaped member is positioned over top of the bobbin.

7. The ejection mechanism as described in claim 4 wherein the cup receives the resilient member.

8. An ejection mechanism for a buckle assembly, the ejection mechanism comprising:

a housing including an upper rotary handle and a lower base, the housing adapted to lockingly receive a plurality of tangs about a peripheral extent;

a binding post centrally positioned within the housing and interconnecting the rotary handle to the base;

a plurality of pawls positioned within the housing, each of the pawls having an upper beveled surface and a lower foot, the number of pawls corresponding to the number of tangs, each pawl having a raised position wherein it locks the corresponding tang within the housing and a lowered position wherein the tang can be ejected from the housing;

a disengagement plate with a central aperture, the disengagement plate positioned within the housing and contacting the lower feet of the pawls;

a spring cup positioned about the binding post, the spring cup having a lower end, an internal peripheral area, and an upper peripheral lip, the lip contacting the central aperture of the disengagement plate, a elastomeric compression spring positioned within the inner peripheral area;

a water dissolvable bobbin positioned about the binding post, the bobbin supporting the lower end of the spring cup, the bobbin dissolving in the presence of water, whereby the lower end of the spring cup is released and the compression spring forces the spring cup and disengagement plate downward to thereby release the tangs;

a timing diffuser positioned over the bobbin, the timing diffuser formed from a cylindrical cap with a series of drainage apertures, the drainage apertures regulating the volume of water contacting the water dissolvable bobbin.

9. An ejection mechanism for a buckle assembly, the ejection mechanism being automatically triggered in the presence of water, the ejection mechanism comprising:

a housing including an upper rotary handle and a lower base, the housing adapted to lockingly receive a plurality of tangs about a peripheral extent;

a plurality of pawls positioned within the housing, each of the pawls having an upper beveled surface and a lower foot, the number of pawls corresponding to the number of tangs, each pawl having a raised position wherein it locks a corresponding tang within the housing and a lowered position wherein the corresponding tang is ejected;

a binding post centrally positioned within the housing and interconnecting the rotary handle to the base;

an actuator slidably positioned over the binding post, the actuator having an upper end, a lower end, and a step located between the upper and lower ends, the actuator having raised and lowered positions;

a disengagement plate with a central aperture, the disengagement plate positioned within the housing and contacting the lower feet of the pawls, the central aperture of the disengagement plate being secured to the actuator, the disengagement plate having raised and lowered positions;

a spring cup having an opened lower end with a peripheral edge and an upper end with a central aperture, the actuator positioned within the central aperture of the spring cup, with the step of the actuator contacting the spring cup, a wave spring positioned about the spring cup and contacting the lower peripheral edge, the spring cup having raised and lowered positions;

a water dissolvable bobbin positioned within the opened lower end of the spring cup and supporting the lower end of the actuator, the bobbin dissolving in the presence of water, wherein when the bobbin is dissolved, the lower end of the actuator is released and the wave spring forces the spring cup, actuator, and disengagement plate to the lowered position, whereby the tangs are released;

drainage apertures within the upper end of the spring cup, the drainage apertures regulating the volume of water contacting the water dissolvable bobbin.

* * * * *